United States Patent [19]

Remondino

[11] Patent Number: 4,953,450

[45] Date of Patent: Sep. 4, 1990

[54] CRAWL SPACE VENTILATOR SYSTEM

[75] Inventor: Paul D. Remondino, Spring Lake, Mich.

[73] Assignee: Windward Products, Inc., Grand Haven, Mich.

[21] Appl. No.: 404,109

[22] Filed: Sep. 6, 1989

[51] Int. Cl.[5] ..... F24F 7/007

[52] U.S. Cl. ..... 98/33.1; 98/42.04

[58] Field of Search ..... 98/33.1, 39.1, 42.04

[56] References Cited

U.S. PATENT DOCUMENTS 4,829,882 5/1989 Jackson ..... 98/33.1

FOREIGN PATENT DOCUMENTS 53331 5/1981 Japan ..... 98/42.04

22141 1/1986 Japan ..... 98/42.04

147243 7/1987 Japan ..... 98/42.04

*Primary Examiner*—Harold Joyce

*Attorney, Agent, or Firm*—Price, Heneveld, Cooper, DeWitt & Litton

[57] ABSTRACT

A method, system and apparatus for venting the foundation of a building having a space provided below the floor of the building. Such space is ventilated by exhausting air from the space and drawing air into the space, only after sundown and before sunrise. In the preferred form, a photocell is utilized to set the system into operation by energizing a timer switch which, after it becomes dark as determined by such photocell, a ventilating fan is actuated for a predetermined time and for a predetermined time interval before sunrise.

14 Claims, 2 Drawing Sheets

FIG. 3
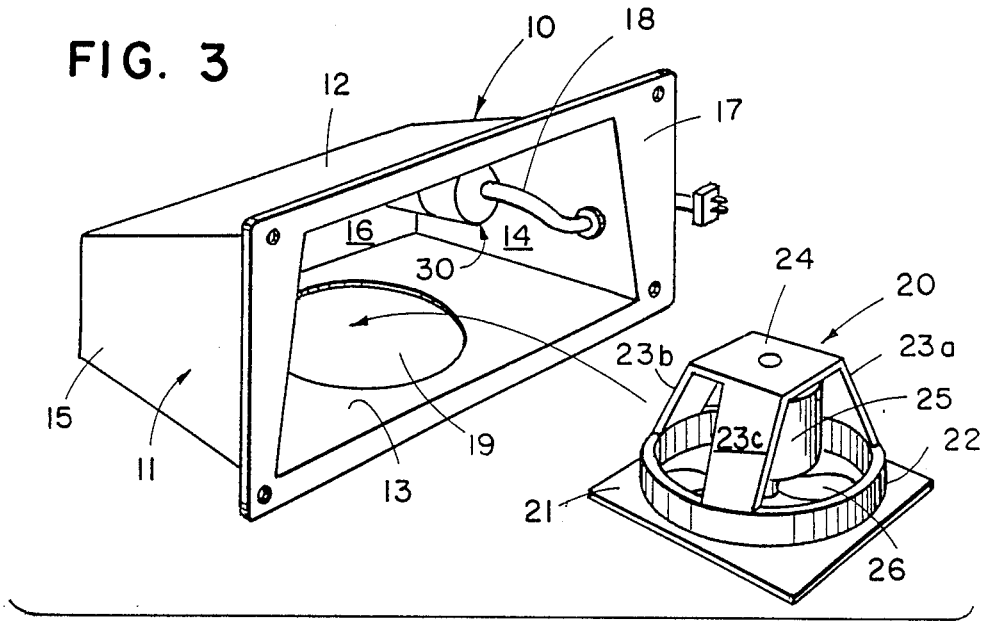
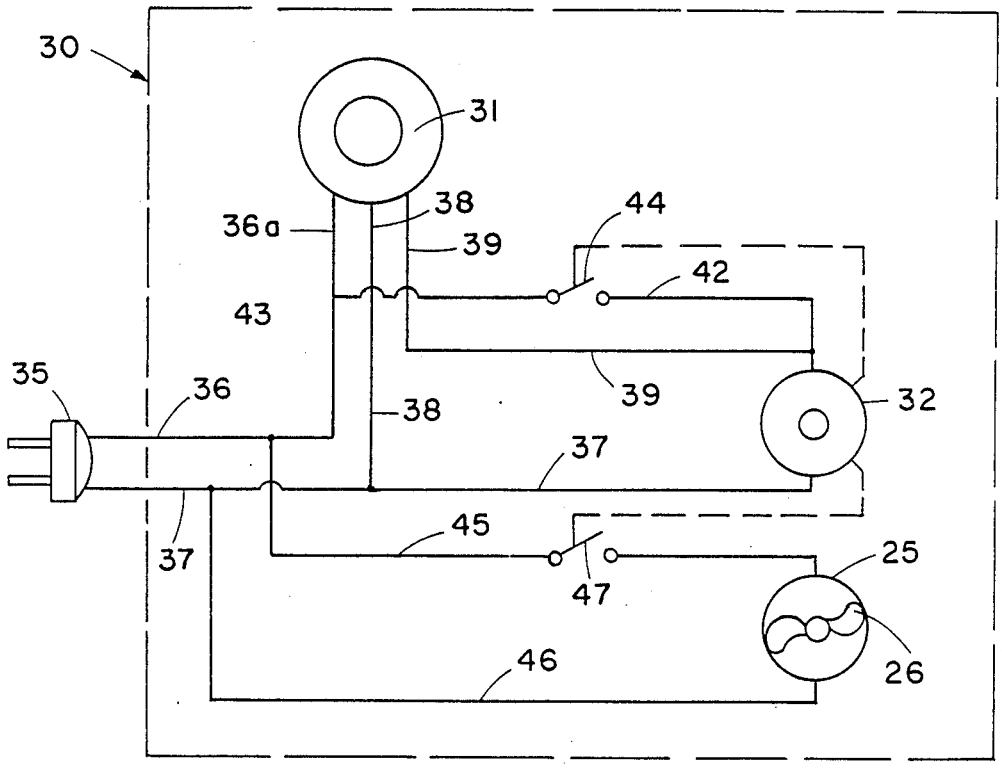
FIG. 4

CRAWL SPACE VENTILATOR SYSTEM

This invention relates to a crawl space ventilator system for reducing moisture in crawl space foundation areas by exhausting the moist air in the crawl space and replacing it with dryer air from outside of the building.

BACKGROUND OF THE INVENTION

In many areas of the country, the moisture content of the crawl space under buildings that do not have basements have created quite a problem. The moisture retained in the crawl space causes the floor joist to eventually rot. Many buildings have their floors insulated in which event the moisture in the crawl space waterlogs the insulation. Also, the moisture causes mold and mildew growth and related odors. Moisture also increases the insect population. All of these are only some of the problems created by moisture in the crawl space and, as a result, attempts have been made to eliminate such moisture by ventilating the crawl space, but to my knowledge none of these attempts have ever been completely satisfactory. The present invention seeks to solve these moisture related problems.

SUMMARY OF THE INVENTION

The present invention affords apparatus and methods for reducing the moisture content of this crawl space under buildings, thus reducing rot, mildew, insect population and also allowing the building to pass the joist moisture content measurement, all of which results in cost savings. Also, the present invention reduces the home contamination such as Raydon and foul odors that accompany crawl spaces in which the moisture content is high.

The present invention solves this problem by providing a method, system and apparatus for venting the crawl space of the foundation of the building by providing an inlet opening for admitting air into this crawl space and an exhaust opening for exhausting the air from the space. A ventilating means is provided for drawing air into the crawl space through the inlet and exhausting the air out of the space. The key to my invention is controlling the time when the ventilating means is operated. Such ventilating means is operated only after sunset and before sunrise. The reason for this is that the moist air in the crawl space is removed during the time that the air outside the building is the driest. Such time is after the dew is allowed to settle which in most areas is between 2:00 a.m. and 6:00 a.m.

I accomplish the exhausting of the air in the crawl space and pulling the night dry air into the space by providing a timer that is actuated at sundown. This timer is in turn started by a photocell that senses the light condition outside of the building so as to be responsive to darkness and thus starts the timer only after darkness. The timer turns the ventilating fan on after a delay sufficient to allow the dew to settle and then it later turns the fan off some time before sunrise. By this system the requirement of running the fan at a time when the outside air is drier than the air in the crawl space is fulfilled.

The objects and advantages of this invention will appear from the following detailed description of the preferred embodiment, reference being made to the accompanying drawings.

BRIEF DESCRIPTION OF THE DRAWINGS

FIG. 3 is an exploded, perspective view of the housing for the ventilator unit and the fan component.

FIG. 4 is an electrical circuit diagram for controlling the ventilating fan.

DESCRIPTION OF THE PREFERRED EMBODIMENT

Figure 1:
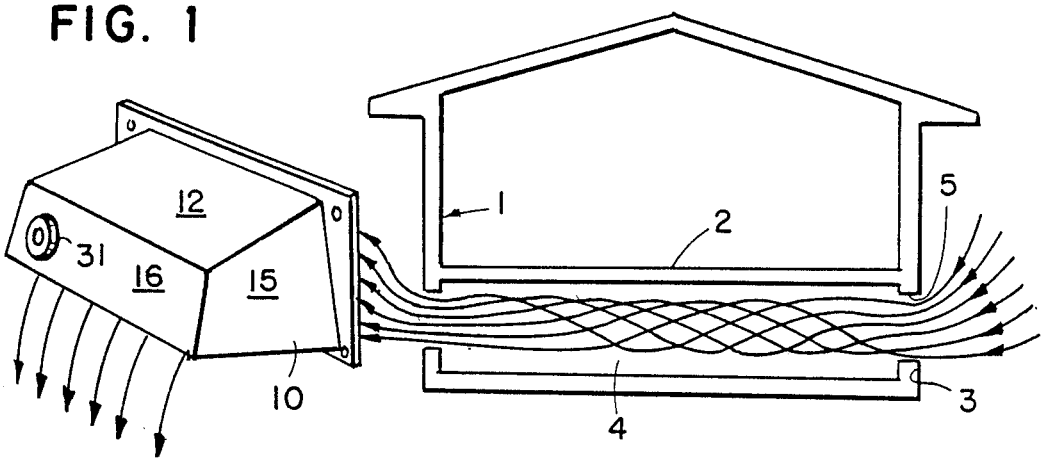
FIG. 1 is a schematic view illustrating the system and apparatus.
Figure 2:
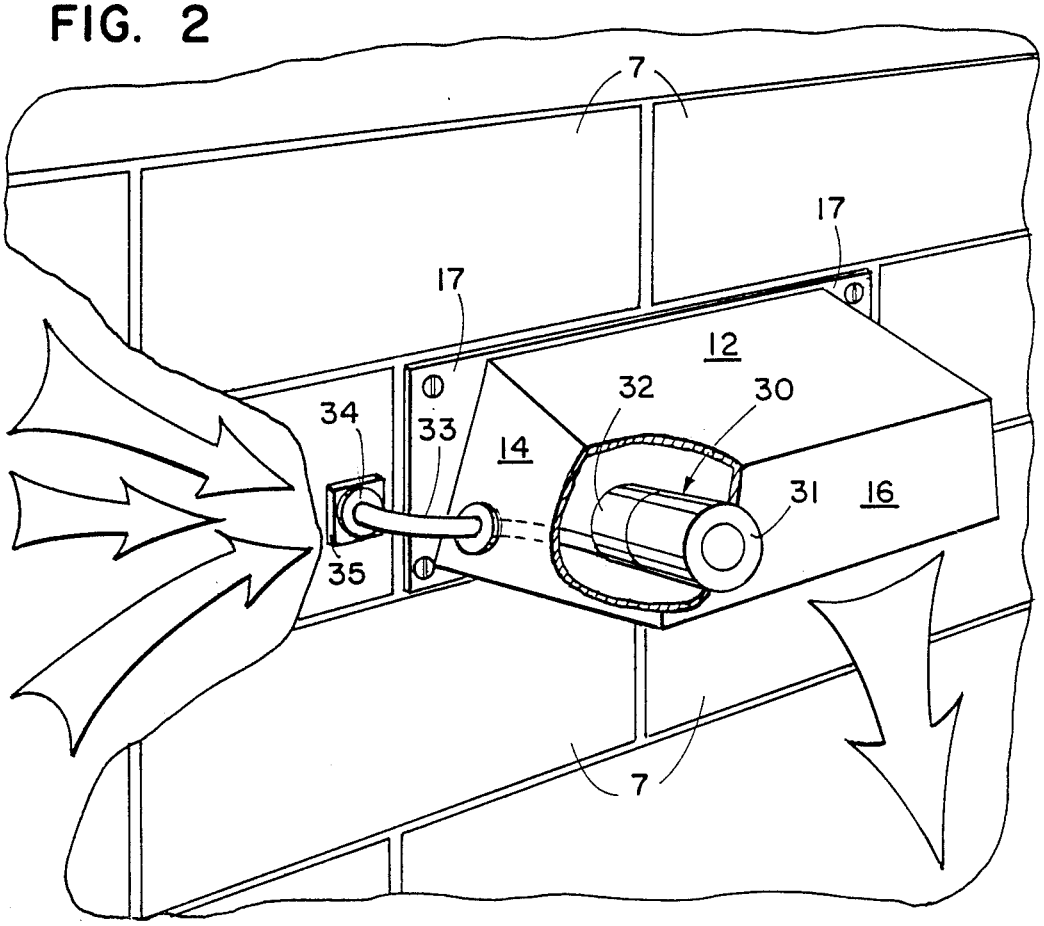
FIG. 2 is a perspective view of the ventilating unit of my invention cut away to show the location of the fan control elements.

Referring now to the drawings in detail, FIG. 1 discloses the environment in which the invention takes place and is used. Reference numeral 1 designates a building having a floor 2, a foundation 3 and a crawl space underneath the floor surrounded by the foundation. It is in this crawl space 4 where moisture accumulates and causes the problems previously referred to. In accordance with this invention, the foundation 3 has an inlet opening 5 and an exhaust opening or outlet 6 in which is located the ventilating unit 10 which draws the moist air out of the crawl space 4 through the outlet 6 while at the same time drawing the more dry air into the crawl space through the inlet 5, all of which is demonstrated by the arrows as disclosed in FIG. 1.

The ventilating unit 10 includes a housing 11 which has a truncated shape formed by the top wall 12, the bottom wall 13, the side walls 14 and 15 and the end wall 16. Opposite the end wall 16 is the mounting flange 17 of substantially the same rectangular shape and size as the block 7 of the foundation. The flange 17 frames an opening 18 which fits over the outlet opening 6 of the foundation 3 and provides for the egress of the moist air drawn out of the crawl space 4.

The bottom wall 13 has an opening 19 over which the fan assembly 20 is mounted.

The fan assembly comprises the mounting flange 21 to which is secured the cowling 22 which has three support members **23*a*, 23*b* and 23*c* extending upwardly and terminating in the support plate 24 on which the fan motor 25 is 10 mounted. The fan motor 25 rotates the blades 26 which draws the air out of the crawl space 4 and exhausts it through the opening 19 of the housing 11**.

Mounted on the housing is the control unit 30 which controls the timing of the operation of the fan assembly 20. Control unit 30 includes a photocell unit 31 and a timer switch unit 32. Extending from the control unit 30 is the electrical wire cable 33 having a plug 34 extending through the wall 14 of the housing and plugged into the electrical outlet 35.

FIG. 4 discloses the circuit diagram for controlling the operation of the motor 25 of the fan assembly 20. FIG. 4 discloses the plug 35 from which extends the conductors 36 and 37 to which the photocell unit 31 is connected by the conductors **36*a* and 38. The photocell unit 31 is also connected by conductor 39 to the motor of the timer switch 32 which is also connected to conductor 37. The motor of the timer switch 32 is also connected to the conductor 42 which in turn is connected at 43 to the conductor 36. A clock running switch 44 is connected in the conductor line 42**.

The fan motor 25 is connected to the conductors 36 and 37 by the conductors 45 and 46 respectively. Timer switch 47, located in the conductor line 45, is opened and closed by the timer switch 32 which also controls the opening and closing of the clock running switch 44.

The sequence of operation of the circuit 32 begins with the actuation of the photocell unit 31 which in response to darkness at sundown closes the circuit comprising the conductors 36, 36a and 39, the motor of timer 10 switch 32 and the conductor 37. This starts the motor of the timer switch causing the timer switch after a time interval to close the clock running switch 44. At that time the circuit through the motor of the timer switch 32 is closed by the photocell unit 31 and also the clock running switch 44. Subsequently, after a set time delay, the switch in the photocell unit 31 opens but the circuit through the timer motor of the timer switch 32 remains closed due to the clock running switch 44. After approximately six hours, the timer switch 32 closes the switch 47 closing the circuit through conductors 36 and 45, the motor 25 of the fan 20 and the conductors 46 and 37. The running of the fan occurs sometime within the time frame of 2:00 a.m. to 6:00 a.m., i.e., after sundown and before sunrise, it being understood that the times may vary depending upon the geographical location of the building. Before this time the temperature of the outside air invariably falls and the dew settles so that during the time the fan is operated the ambient outside temperature is cooler than the air temperature in the crawl space. At a predetermined time before sunrise the timer switch 32 opens the switch contacts 47 to shut off the fan. The entire sequence is repeated when the photocell unit 31 again detects a darkness at sundown.

OPERATION

Having described my invention in detail, the operation of the entire method, system and apparatus should be evident.

The entire system lays dormant during the daylight hours except for possibly the timer which may run its course which preferably is at least twelve hours. At sundown, the photocell unit 31 senses the darkness closing a circuit through the timer switch 32. Shortly thereafter, timer switch 32 closes the contacts of switch 44 and then sometime later the delay switch in the photocell unit 31 opens as the switch 44 maintains a closed circuit through the timer switch 32.

After the timer switch 32 runs for approximately six hours it closes the contacts of switch 47 which actuates the fan 20 causing the moist air to be drawn out of the crawl space and the drier air to be drawn into the crawl space. This preferably continues for about three hours after which the contacts of switch 47 are opened, deenergizing the motor 25 of the fan 20. The timer switch then continues to operate until it runs its course which, as previously stated, is a total of twelve hours at which time it is set to be again energized by the closing of the circuit through the timer switch by means of the photocell sensing darkness at the time of sundown.

Within the broader aspect of this invention the time variants between sundown and sunrise for operation of the ventilating fan can be adjusted for the geographical area in which the building is located and also for the various sizes of crawl spaces to be ventilated. Also, the photocell unit can be designed to adjust the timer for the seasonal variations as well as power outages.

Although I have disclosed a preferred embodiment of this invention, many modifications thereof may be made by a person skilled in the art without departing from the spirit of the invention and it is intended to protect by letters patent all forms of the invention falling within the scope of the following claims.

I claim:

1. A system for venting the foundation of a building in which a space is provided below the floor of the building and the foundation surrounds such space comprising:
   - an inlet opening for admitting air into said space;
   - an exhaust opening for exhausting air from said space;
   - ventilating means for drawing air into said space through said inlet and exhausting air out of said space;
   - control means for controlling the operation of said ventilating means; and
   - means whereby said ventilating means is operated only after sundown and before sunrise.

2. A system for venting the foundation of a building in which a space is provided below the floor of the building and the foundation surrounds such space comprising:
   - an inlet opening for admitting air into said space;
   - an exhaust opening for exhausting air from said space;
   - ventilating means for drawing air into said space through said inlet and exhausting air out of said space;
   - control means for controlling the operation of said ventilating means; and
   - photocell means responsive to the ambient light outside of said building for controlling the operation of said control means whereby said ventilating means is operated only after sundown and before sunrise.

3. The system of claim 1 in which a timer switch means is provided to establish the exact time period between sundown and sunrise when said ventilating means is operated.

4. The system of claim 2 in which a timer switch means is provided to establish the exact time period between sundown and sunrise when said ventilating means is operated.

5. The system of claim 3 in which the timer switch means is set to operate the ventilating means at a time generally after the dew settles.

6. The system of claim 4 in which the timer switch means is set to operate the ventilating means at a time generally after the dew settles.

7. The system of claim 3 in which the ventilating means is generally caused to operate sometime within the time frame of 2:00 a.m. and 6:00 a.m.

8. The system of claim 4 in which the ventilating means is generally caused to operate sometime within the time frame of 2:00 a.m. and 6:00 a.m.

9. An air ventilating unit for exhausting air from the crawl space underneath the floor of a building and replacing it with ambient air outside the building comprising:
   - a housing;
   - an inlet opening in said housing;
   - an exhaust opening in said housing;
   - a fan;
   - a timer switch adapted to control the operation of said fan; and
   - a photocell exposed to the outside of said housing for detecting the ambient light outside the housing for controlling the operation of said timer switch in response to darkness outside the unit.

10. The air ventilating unit of claim 9 in which a timer switch is provided for controlling the operation of said fan, said timer switch being controlled by said photocell.

11. The air ventilating unit of claim 9 in which the ventilating means is generally caused to operate sometime within the time frame of 2:00 a.m. and 6:00 a.m.

12. A method for venting the foundation of a building in which a space is provided below the floor of the building and the foundation surrounds such space comprising:

providing an inlet opening for admitting air into said space;

providing an exhaust opening for exhausting air from said space;

drawing air into said space through said inlet and exhausting air out of said space; and said ventilating step being accomplished only after sundown and before sunrise.

13. The method of claim 12 in which the ventilating step is accomplished only after the dew settles.

14. The method of claim 13 in which the ventilating step is accomplished within the time frame of 2:00 a.m. and 6:00 a.m.

* * * * *